US012564240B1

(12) United States Patent
Brown

(10) Patent No.: US 12,564,240 B1
(45) Date of Patent: Mar. 3, 2026

(54) INFLATABLE WADING BOOTS

(71) Applicant: Matthew Brown, Etowah, TN (US)

(72) Inventor: Matthew Brown, Etowah, TN (US)

( * ) Notice: Subject to any disclaimer, the term of this patent is extended or adjusted under 35 U.S.C. 154(b) by 0 days.

(21) Appl. No.: 18/894,576

(22) Filed: Sep. 24, 2024

(51) Int. Cl.
*A43B 5/04* (2006.01)
*A41D 13/012* (2006.01)

(52) U.S. Cl.
CPC ..... *A43B 5/0407* (2013.01); *A41D 13/012* (2013.01)

(58) Field of Classification Search
CPC .... A41D 13/012; A41D 13/0125; A41D 1/08; A41D 2400/38; A41D 2300/20; A43B 5/0407; B63C 9/1255; B63C 9/13
See application file for complete search history.

(56) References Cited

U.S. PATENT DOCUMENTS 3,154,800 A * 11/1964 Anderson ..... A41D 13/0125 D2/743
5,088,478 A * 2/1992 Grim ..... A43B 7/20 128/DIG. 20
5,454,744 A * 10/1995 Seiler ..... A41D 13/0125 2/82
7,721,352 B1 * 5/2010 Swift ..... A41D 13/0125 2/82
8,978,164 B2 * 3/2015 Jones ..... A41D 1/08 36/117.6
10,477,921 B2 11/2019 Bode

* cited by examiner

*Primary Examiner* — Khoa D Huynh
*Assistant Examiner* — Erick I Lopez
(74) *Attorney, Agent, or Firm* — Sanchelima & Associates, P.A.; Jesus Sanchelima; Christian Sanchelima

(57) ABSTRACT

An inflatable wading boots including a boots assembly and an inflatable assembly. The boots assembly includes wading boots integrated to waders. The inflatable assembly includes a bladder, and a bulb. The bladder is an inflatable bladder. The bulb is an air pump. The bladder is connected to the pump. The bladder and the pump are mounted to each of the boots. The bladder is inflated to secure the boots to the feet of a user preventing the boots from getting off of the feet. The waders has bladders at a waist portion, a back portion and shoulder portion to inflate and prevent sinking.

9 Claims, 5 Drawing Sheets

INFLATABLE WADING BOOTS

BACKGROUND OF THE INVENTION

1. Field of the Invention

The present invention relates to wading boots and, more particularly, to inflatable wading boots that includes an inflatable bladder to secure the boot to the feet of a wearer.

2. Description of the Related Art

Several designs for wading boots have been designed in the past. None of them, however, include inflatable wading boots that has a pump to inflate a bladder to secure the boot to the feet of the user.

Applicant believes that a related reference corresponds to U.S. Pat. No. 8,978,164 issued for a secure fit between feet and/or ankles of an individual and boot sections of wader pants that uses inflatable membranes. Applicant believes that another related reference corresponds to U.S. Pat. No. 10,477,921 issued for an air bladder boot fitting device that facilitates snug fitting to prevent unintended removal of boot. None of these references, however, teach of inflatable wading boots having an integral inflatable bladder system for securing the boot to the food of the wearer.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide inflatable wading boots that includes a bladder to snugly fit the boot to the ankle of a user preventing the boot from getting off.

It is another object of this invention to provide inflatable wading boots that includes inflatable bladders that allow the boots to float when a user falls overboard in a boat.

It is still another object of the present invention to provide inflatable wading boots that aids a user to walk through mud without losing the boots.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
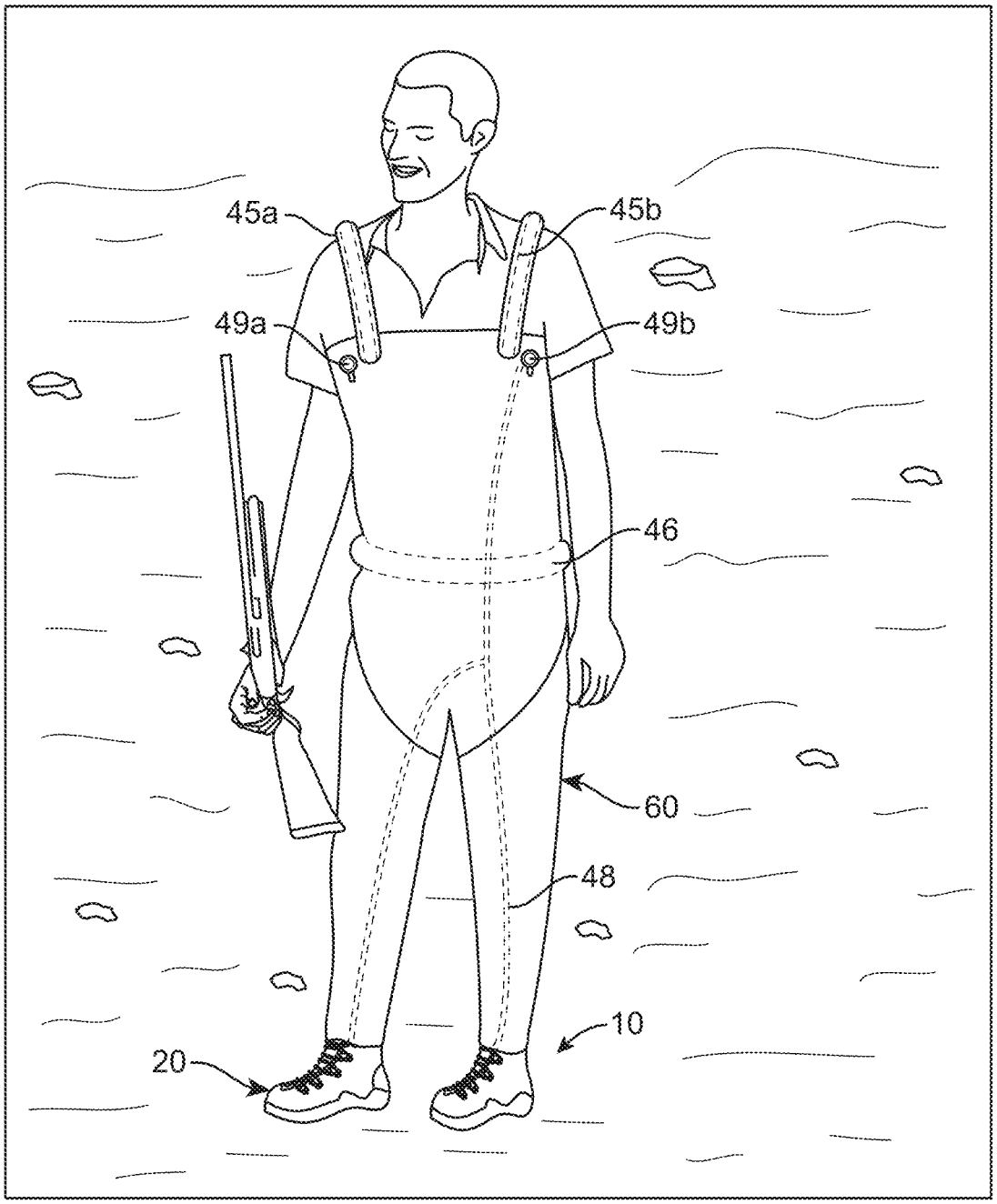
FIG. 1 represents an isometric operational view of the present invention 10 showing a user wearing the boots assembly 20 and walking through mud.

Referring now to the drawings, where the present invention is generally referred to with numeral 10, it can be observed that it basically includes a boots assembly 20 and a inflatable assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The boots assembly 20 includes a pair of boots. Each boot 22 has an upper portion configured to cover the foot of a user including an portion above the ankle. The boot 22 may have a rear portion higher than a front portion. The boot 22 may have an opening at the top portion of the rear portion thereof that allows a user to introduce a foot therein. The boot 22 may be hollow. In one of the preferred embodiments, the boot 22 may be made of rubber. It also may be suitable to have the boot 22 of other materials such as polymers, treated leather textiles, or any suitable waterproof material. The boot 22 may be a waterproof boot. The boot 22 may have a lower portion comprising an outsole. The outsole may be made of a rugged, slip-resistant material suitable for providing traction on slippery surfaces such as wet rocks. The boot 22 may be comfortable and provide The boot 22 may be any suitable wading existing boot. The boot 22 may be provided in any color and design.

Figure 2:
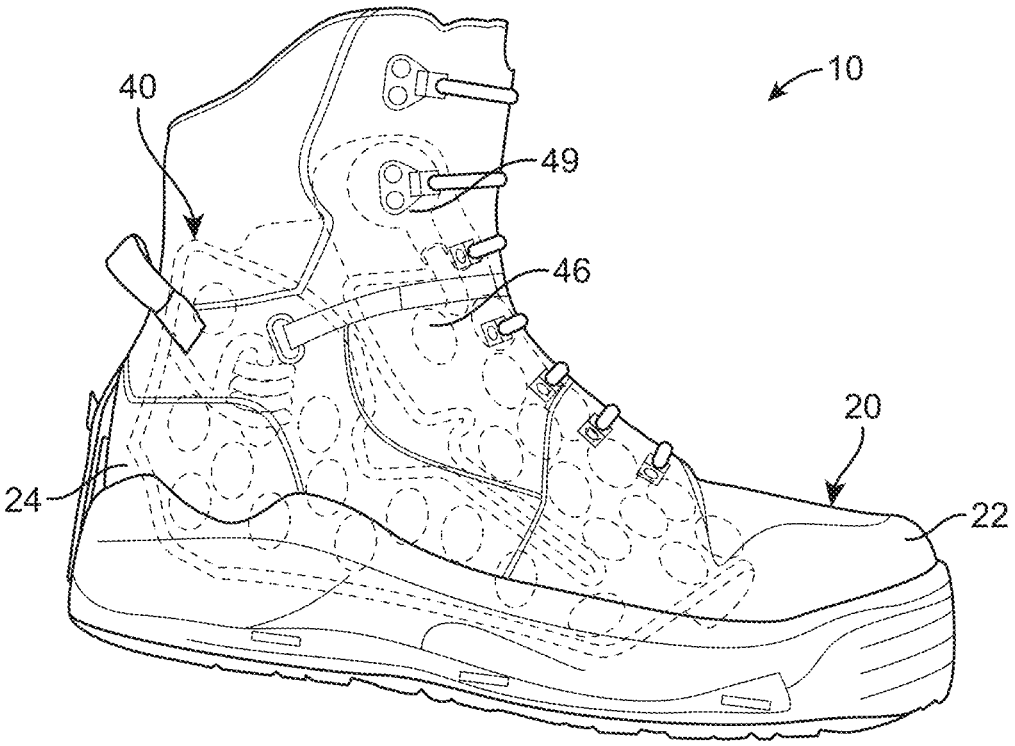
FIG. 2 shows an isometric view of the present invention showing the boots assembly 20 with the inflatable assembly 40 embedded therein.
Figure 3:
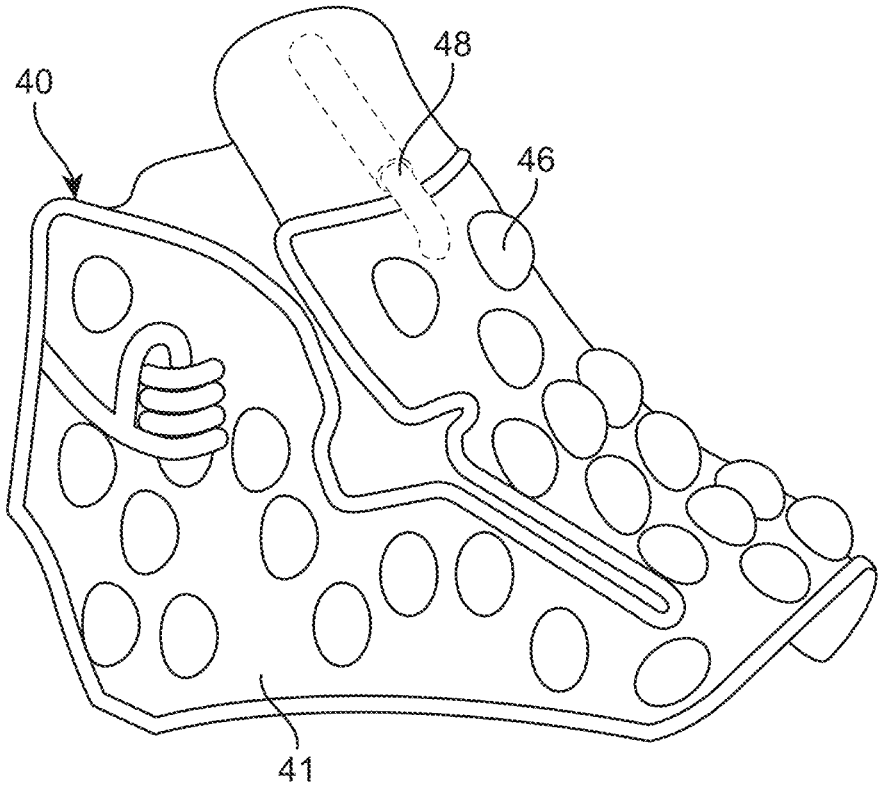
FIG. 3 is an isometric view of the inflatable assembly 40 showing the inflatable bladder 41 with the inflatable portions 46.
Figure 4:
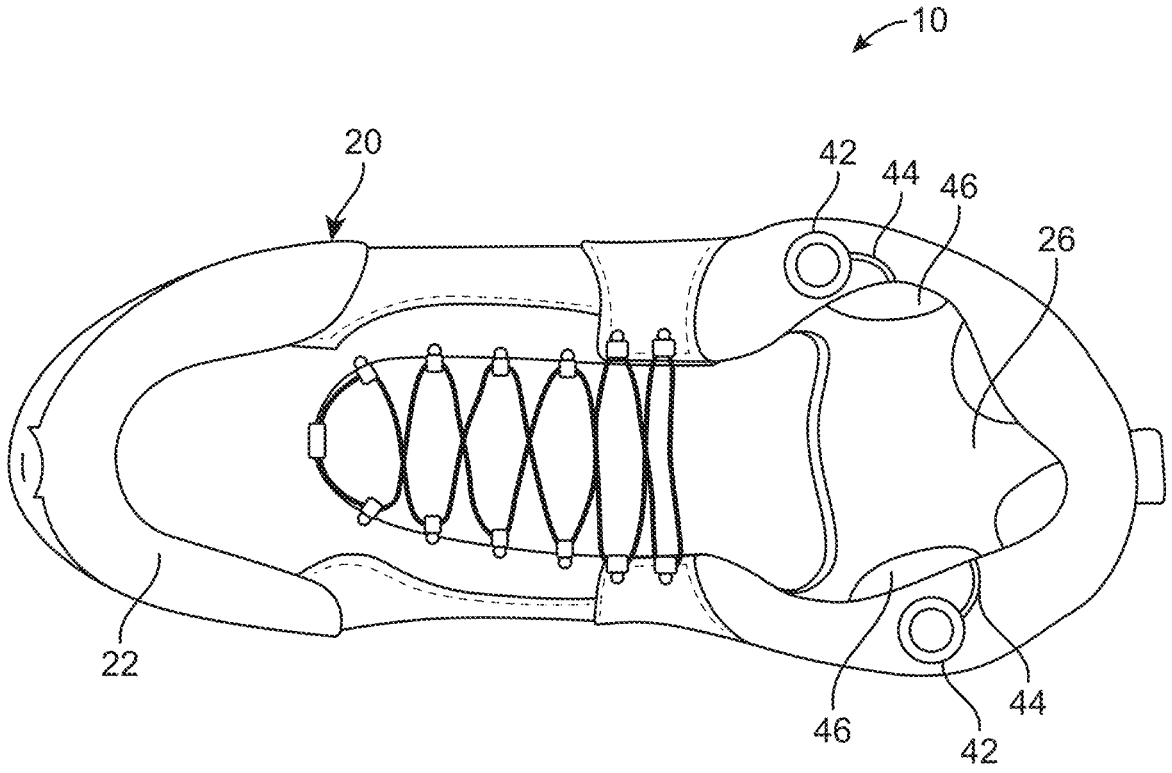
FIG. 4 is a top view of the present invention 10 showing the inflatable portions 46 on an interior portion 26 of the boot 22.

Best observed in FIG. 3, the inflatable assembly 40 includes an inflatable bladder 41. In one of the preferred embodiments, the inflatable bladder 41 may be a inflatable bladder designed to be embedded on an interior portion 26 of the boots assembly 20 as observed in FIG. 2. The inflatable bladder 41 may have a plurality of inflatable portions 46. The inflatable portions 46 may be made of an inflatable material. The inflatable portions 46 may be inflated with air to adjust the fit of the boot 22 on the feet. The inflatable bladder 41 may be located on an ankle boot portion 24 defining inflatable ankle portions. The inflatable bladder 41 may be integrated to the interior portion 26. The inflatable bladder 41 may be sewed to the boot 22. The inflatable portions 46 may be inflated to press against the foot of the wearer, thereby securing the boot 22 to the foot and preventing unintentional removal. The snuggly inflatable bladder 41 may hold each boot firmly in place preventing the boots from sliding off the feet when walking in the mud. The boots may be integrated to the duck waders 60.

Preferably, the inflatable bladder 41 may be an air pocket filled. The inflatable bladder 41 may be made of flexible polymers, rubber, or other suitable expandable or inflatable material. The inflatable portions 46 may be unobtrusive and smalls when not inflated. The inflatable bladder 41 may be inflated with air provided by the second bulb 49*b* through the air hose 48. The air hose 48 may communicate the second bulb 49*b* with the inflatable bladder 41 to inflate the boots. The air hose 48 may be located on interior of the duck waders 60.

Figure 5:
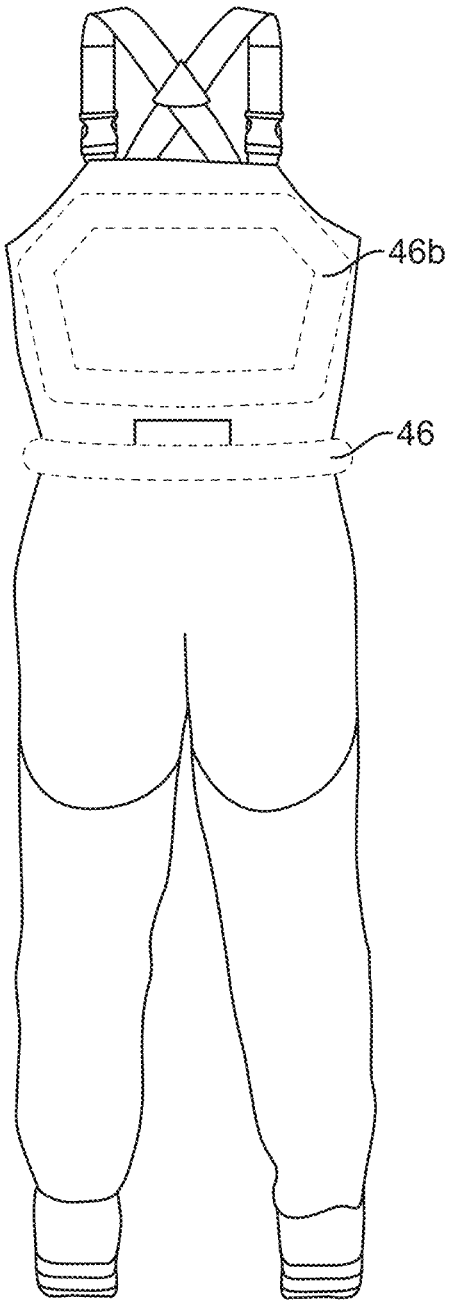
FIG. 5 is an internal rear view of the duck waders 60 showing back bladder 46*b* embedded to a back portion of the duck waders 60.

The inflatable assembly 40 may further include inflatable waist bladder 46 as observed in FIG. 1. The inflatable waist bladder 46 may be located on a waist portion of duck waders 60. The inflatable waist bladder 46 may be an internal bladder located inside the waist portion of the duck waders 60. The inflatable waist bladder 46 may also be located on a back portion of the duck waders 60. The duck waders 60 may be retrofitted to include the inflatable portions 46. The duck waders 60 may further include inflatable shoulder bladders 45*a*. The inflatable shoulder bladders 45*a* may be located on shoulder portions of the duck waders 60. The inflatable shoulder bladders 45*a* may be selectively inflated with air to allow the user to float when falling into water of a lake. The inflatable shoulder bladders 45*a* may be integrated to the duck waders 60. The inflatable shoulder bladders 45*a* may have internal inflatable bladders 45*b*. Best observed in FIG. 5, the duck waders 60 may have a back bladder 46*b* on an internal portion of the back portion of the duck waders 60.

The inflatable shoulder bladders 45*a*, the back bladder 46*b*, the inflatable waist bladder 46 and the internal inflatable bladders 45*b* may be inflated with air pumped by a first bulb 49*a*. The first bulb 49*a* and the second bulb 49*b* may be located on a top portion of the duck waders 60. It should be understood that the first bulb 49*a* and the second bulb 49*b* may be located in any other suitable place of the waders. It should be understood that preferably all the bladders may be enclosed inside the duck waders 60 and the boots. The first bulb 49*a* and the second bulb 49*b* may be pumps with release valves to selectively inflate and deflate the each of the bladders in the duck waders 60 and the boots assembly 20. The first bulb 49 and second bulb 49*b* may include pressure release valves to avoid overinflating of the bladders.

The present invention may be used by duck hunters or fishermen when hunting or fishing in the mud and lakes. It should be understood that the inflatable bladder 41 provided in the interior of the boot 22 may be configured to be disposed around the ankles of the user to keep the boots secured to the feet when walking in the mud. The inflatable bladder 41 and the inflatable shoulder bladders 45*a* may allow the user to float in a lake if the user falls when hunting.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An inflatable wading boots, comprising:

a) a boots assembly including boots, wherein said boots are wading boots, wherein each boot has a rear portion higher than a front portion, with an opening at a top of the rear portion for foot insertion, and a lower portion comprising a rugged, slip-resistant outsole;

b) an inflatable assembly including an integral inflatable bladder mounted to each of the wading boots, said inflatable bladder is configured to secure the wading boots to the feet of a wearer, wherein the inflatable bladder comprises a plurality of interconnected oval-shaped inflatable portions arranged circumferentially around an interior ankle portion of each wading boot.

2. The inflatable wading boots set forth in claim 1, wherein the inflatable bladder is mounted on an interior portion of each of the wading boots.

3. The inflatable wading boots set forth in claim 2, wherein the inflatable bladder is disposed around a boot ankle portion of each of the wading boots.

4. The inflatable wading boots set forth in claim 1, wherein the inflatable bladder is made of rubber.

5. The inflatable wading boots set forth in claim 1 further including a bulb and inflatable portions, said bulb is configured to pump air to said inflatable portions, thereby inflating the inflatable bladder, further including an air hose connecting the bulb to the inflatable portions.

6. The inflatable wading boots set forth in claim 1 further including duck waders, wherein said duck waders includes an inflatable waist bladder, inflatable shoulder bladders, and an inflatable back bladder embedded in the duck waders, wherein the inflatable waist bladder, inflatable shoulder bladders, and inflatable back bladder are embedded internally within the duck waders, and wherein the inflatable shoulder bladders include internal inflatable sub-bladders.

7. The inflatable wading boots set forth in claim 6, wherein the inflatable shoulder bladders, the inflatable waist bladder, and the inflatable back bladder are inflated by a second bulb.

8. An inflatable wading boots, comprising:

a) duck waders;

b) a boots assembly including boots, wherein said boots are wading boots, said boots are integrated to the duck waders, wherein each boot has a rear portion higher than a front portion, with an opening at a top of the rear portion for foot insertion, and a lower portion comprising a rugged, slip-resistant outsole; and c) an inflatable assembly including a first bulb, a second bulb, ankle inflatable portions, waist inflatable portions, a back inflatable portion, and shoulder inflatable portions, wherein the waist inflatable portions, the back inflatable portion, and the shoulder inflatable portions are inflated by air provided by the first bulb, wherein the ankle inflatable portions are embedded inside the boots, said ankle inflatable portions are inflated with air provided by the second bulb through a hose, said first bulb and said second bulb include release valves to deflate the ankle inflatable portions, the waist inflatable portions, the back inflatable portion, and the shoulder inflatable portions, wherein the ankle inflatable portions comprise a plurality of interconnected oval-shaped portions arranged circumferentially around an interior ankle portion of each wading boot, wherein the hose is located on an interior of the duck waders, wherein the shoulder inflatable portions include internal inflatable sub-portions, wherein the first bulb and the second bulb include pressure release valves to prevent overinflation, and wherein the waist inflatable portions, shoulder inflatable portions, and back inflatable portion are embedded internally within the duck waders.

9. An inflatable wading boots, consisting of:

a) duck waders;

b) a boots assembly including boots, wherein said boots are wading boots, said boots are integrated to the duck waders, wherein each boot has a rear portion higher than a front portion, with an opening at a top of the rear portion for foot insertion, and a lower portion comprising a rugged, slip-resistant outsole; and c) an inflatable assembly including a first bulb, a second bulb, ankle inflatable portions, waist inflatable portions, a back inflatable portion, and shoulder inflatable portions, wherein the waist inflatable portions, the back inflatable portion, and the shoulder inflatable portions are inflated by air provided by the first bulb, wherein the ankle inflatable portions are embedded inside the boots, said ankle inflatable portions are inflated with air provided by the second bulb through a hose, said first bulb and said second bulb include release valves to deflate the ankle inflatable portions, the waist inflatable portions, the back inflatable portion, and the shoulder inflatable portions, wherein the ankle inflatable portions comprise a plurality of interconnected oval-shaped portions arranged circumferentially around an interior ankle portion of each wading boot, wherein the hose is located on an interior of the duck waders, wherein the shoulder inflatable portions include internal inflatable sub-portions, wherein the first bulb and the second bulb include pressure release valves to prevent overinflation, and wherein the waist inflatable portions, shoulder inflatable portions, and back inflatable portion are embedded internally within the duck waders.

* * * * *